US006401971B1

(12) United States Patent
Edwards et al.

(10) Patent No.: US 6,401,971 B1
(45) Date of Patent: Jun. 11, 2002

(54) BAG STORAGE AND DISPENSING SYSTEM

(76) Inventors: Robert L. Edwards, 3548 Brewster Dr., Plano, TX (US) 75025; Brian C. Ernst, 1632 Silverleaf Dr., Carrollton, TX (US) 75007; Ron Youngman, 5400 Preston Oaks Rd. #1038, Dallas, TX (US) 75240

( * ) Notice: Subject to any disclaimer, the term of this patent is extended or adjusted under 35 U.S.C. 154(b) by 111 days.

(21) Appl. No.: 09/688,364

(22) Filed: Oct. 12, 2000

(51) Int. Cl.[7] ..... B65H 3/58
(52) U.S. Cl. ..... 221/26; 221/27
(58) Field of Search ..... 221/26, 27; 206/554

(56) References Cited

U.S. PATENT DOCUMENTS

| | | | | |
|---|---|---|---|---|
| 1,002,639 | A | | 9/1911 | Broussard |
| 1,469,162 | A | | 9/1923 | Lesler |
| 2,682,956 | A | | 7/1954 | Pike |
| 3,285,407 | A | | 11/1966 | Abramson |
| 3,306,492 | A | | 2/1967 | Kugler |
| 3,341,003 | A | | 9/1967 | Marsh |
| 3,346,104 | A | | 10/1967 | Marsh ..... 206/57 |
| 3,827,571 | A | | 8/1974 | Koutny |
| 4,527,693 | A | | 7/1985 | Membrino ..... 206/554 |
| 4,537,330 | A | | 8/1985 | Gelbard |
| 4,542,827 | A | | 9/1985 | Pilzer |
| 4,676,378 | A | | 6/1987 | Baxley et al. |
| 5,060,809 | A | | 10/1991 | Bayes et al. |
| 5,060,897 | A | | 10/1991 | Thalenfeld |
| 5,074,674 | A | | 12/1991 | Kuklies et al. |
| 5,096,089 | A | * | 3/1992 | McLaughlin ..... 221/26 |
| 5,119,968 | A | | 6/1992 | Palmer |
| 5,176,286 | A | | 1/1993 | Snowdon ..... 221/45 |
| 5,184,728 | A | | 2/1993 | Wile |
| 5,332,097 | A | | 7/1994 | Wile |
| 5,368,165 | A | | 11/1994 | Ngyuen |
| 5,450,964 | A | | 9/1995 | Miller |
| 5,524,763 | A | | 6/1996 | Wile ..... 206/554 |
| 5,655,682 | A | | 8/1997 | Hoffrichter ..... 221/45 |
| 5,695,065 | A | | 12/1997 | Kennedy et al. |
| 6,098,806 | A | | 8/2000 | Mills ..... 206/554 |
| 6,179,126 | B1 | * | 1/2001 | Smithson et al. ..... 206/554 |

FOREIGN PATENT DOCUMENTS

| | | | | |
|---|---|---|---|---|
| GB | 2035264 | A | * | 6/1980 ..... 221/26 |

* cited by examiner

*Primary Examiner*—David H. Bollinger
(74) *Attorney, Agent, or Firm*—Locke Liddell & Sapp LLP

(57) ABSTRACT

A system for storing and dispensing bags wherein the bags each have a top and bottom, and an aperture disposed adjacent the bag top, includes a container having a top panel, a bottom panel, first and second side panels, and first and second end panels. Structure is disposed within the container and attached to the top and bottom panels, and is adapted to pass through the bag apertures for retaining the bags within the container. The container includes an aperture to permit removal of bags from the container through the aperture.

5 Claims, 3 Drawing Sheets

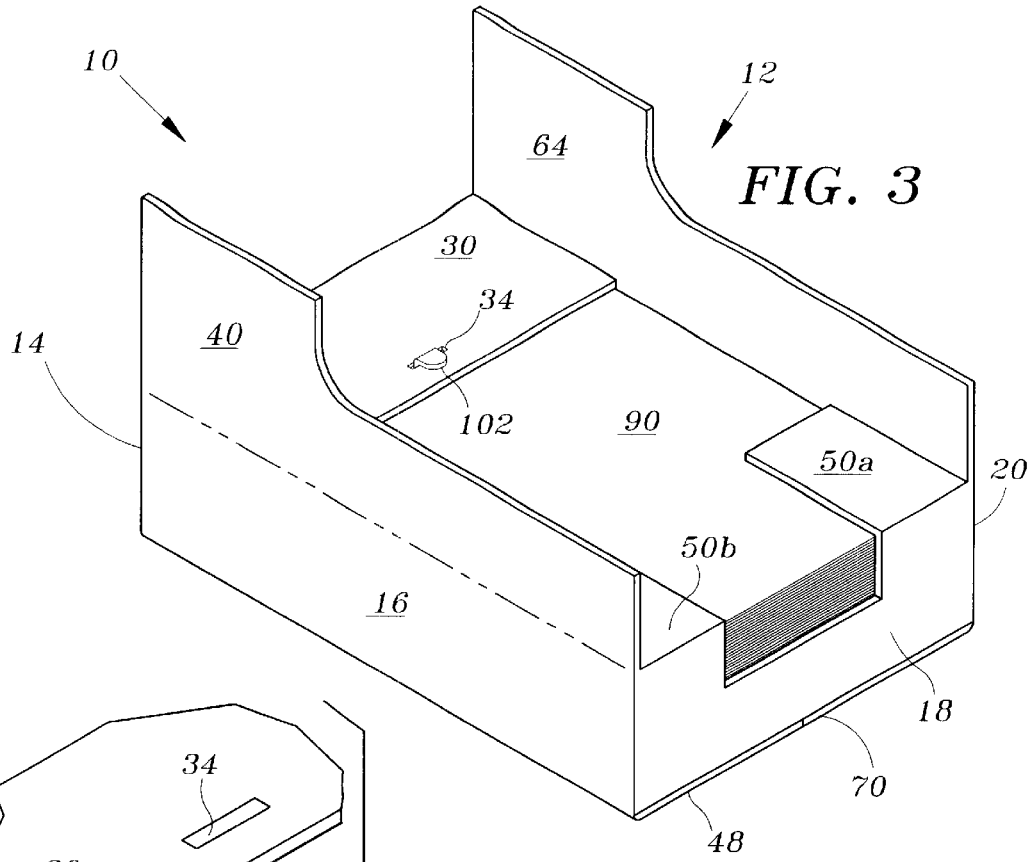
FIG. 3
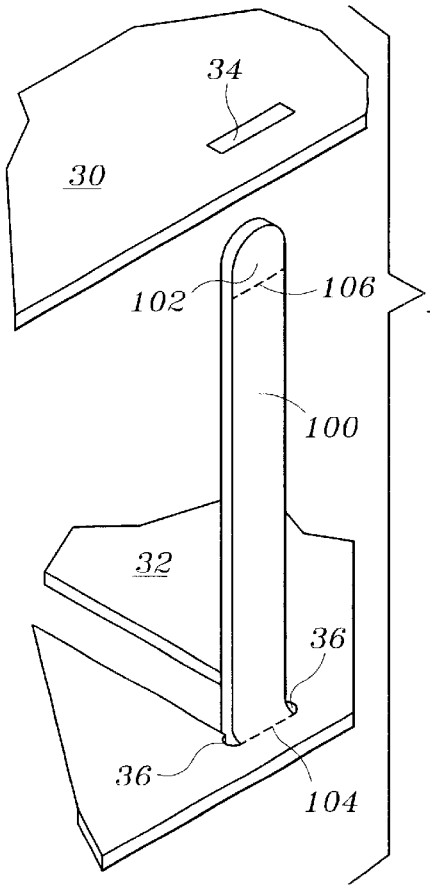
FIG. 5
FIG. 7
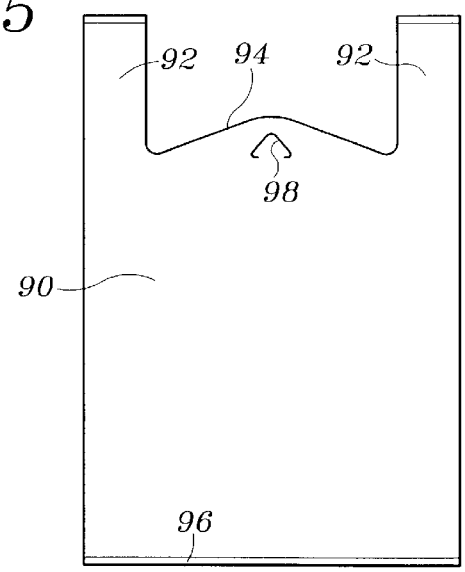

BAG STORAGE AND DISPENSING SYSTEM

TECHNICAL FIELD OF THE INVENTION

The present invention relates to bag dispensing systems, and more particularly to a system for singularly dispensing bags from a storage unit.

BACKGROUND OF THE INVENTION

Plastic bags are widely utilized on the consumer level, particularly for food and related products. However, plastic bags present problems when dispensed from their own packaging. Plastic bags tend to be slippery to the touch, and are generally hard to handle until loaded. There is generally little friction between the walls of adjacent bags, making individual bags difficult to maneuver and control when several are stacked together.

A need has arisen for a bag storage and dispensing system that is quick and easy to use as well as inexpensive to manufacture. A need has further arisen for a dispensing system that is formed directly from the packaging for plastic bags, requiring little set-up and no assembly.

SUMMARY OF THE INVENTION

In accordance with the present invention, a system for storing and dispensing bags wherein the bags each have a top and bottom, and an aperture disposed adjacent the bag top includes a container having a top panel, a bottom panel, first and second side panels, and first and second end panels. Structure is disposed within the container and attached to the top and bottom panels, and is adapted to pass through the bag apertures for retaining the bags within the container. The container includes an aperture to permit removal of bags from the container through the aperture.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 3 is a perspective view of the present system showing the dispenser in a partially constructed position;

FIG. 5 is an exploded perspective view of the retaining structure for the bags of the present system;

FIG. 7 is a plan view of an illustrative bag utilized with the present system.

DESCRIPTION OF THE PREFERRED EMBODIMENTS

Figure 1:
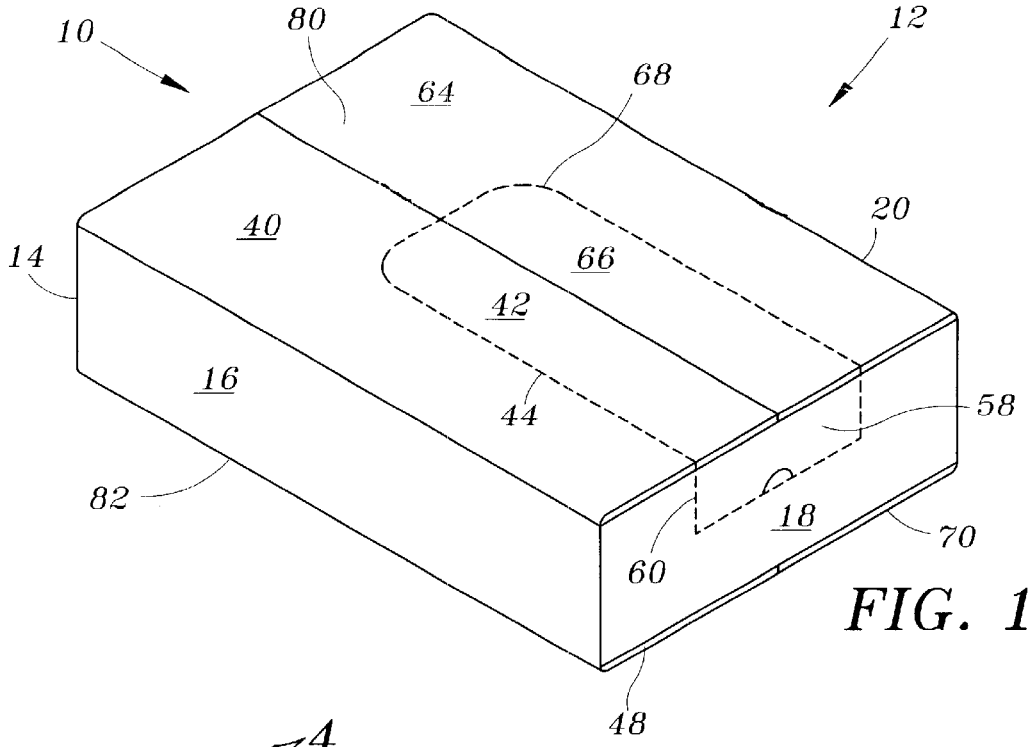
FIG. 1 is a perspective view of the present system for storing and dispensing bags.
Figure 6:
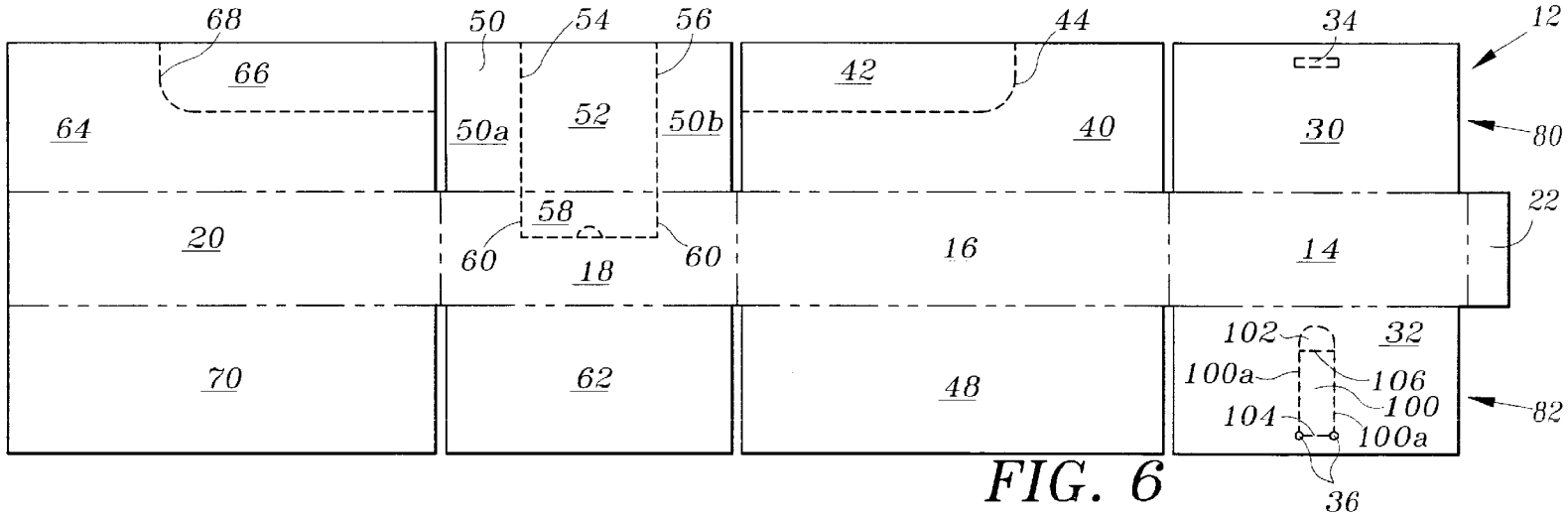
FIG. 6 is a plan view of the present container in an unfolded position.

Referring simultaneously to FIGS. 1 and 6, the present bag storage and dispensing system is illustrated, and is generally identified by the numeral 10. System 10 may be utilized for the storage and dispensing of various types of bags, particularly, plastic bags referred to as "T"-shirt or handle bags, or merchandise bags. System 10 includes a container, generally identified by the numeral 12. Container 12 includes a first end panel 14 which is hingedly attached to a first side panel 16. First side panel 16 is hingedly attached to a second end panel 18. Second end panel 18 is hingedly attached to a second side panel 20. A tab 22 extending from first end panel 14 engages the interior wall of second side panel 20 to integrally form the ends and sides of container 12.

Hingedly attached to first end panel 14 is a top flap 30 and bottom flap 32. Top flap 30 includes a slotted aperture 34. Bottom flap 32 includes apertures 36. Hingedly attached to first side panel 16 is a top flap 40 having a pullout portion 42 defined by a perforation 44. Hingedly attached to first side panel 16 is also a bottom flap 48. Hingedly attached to second end panel 18 is a top flap 50 having a pullout portion 52 defined by perforations 54 and 56. When pullout portion 52 is removed, top flap 50 includes sections 50*a* and 50*b*. Pullout portion 52 is hingedly attached to a pullout portion 58 contained within second end panel 18, and which is defined by perforation 60.

Hingedly attached to second side panel 20 is a top flap 64 including a pullout portion 66 defined by perforation 68. Also hingedly joined to second side panel 20 is a bottom flap 70. Top flap 30, top flap 40, top flap 50, and top flap 64 define a top panel 80 (FIG. 1) for container 12. Bottom flaps 32, 48, 62, and 70 define a bottom panel 82 for container 12. Bottom flaps 48 and 70 may be attached together and to end panels 14 and 18 through the use of tape. Top flaps 40 and 64 may be attached to each other and to end panels 14 and 18 also using tape.

Figure 2:
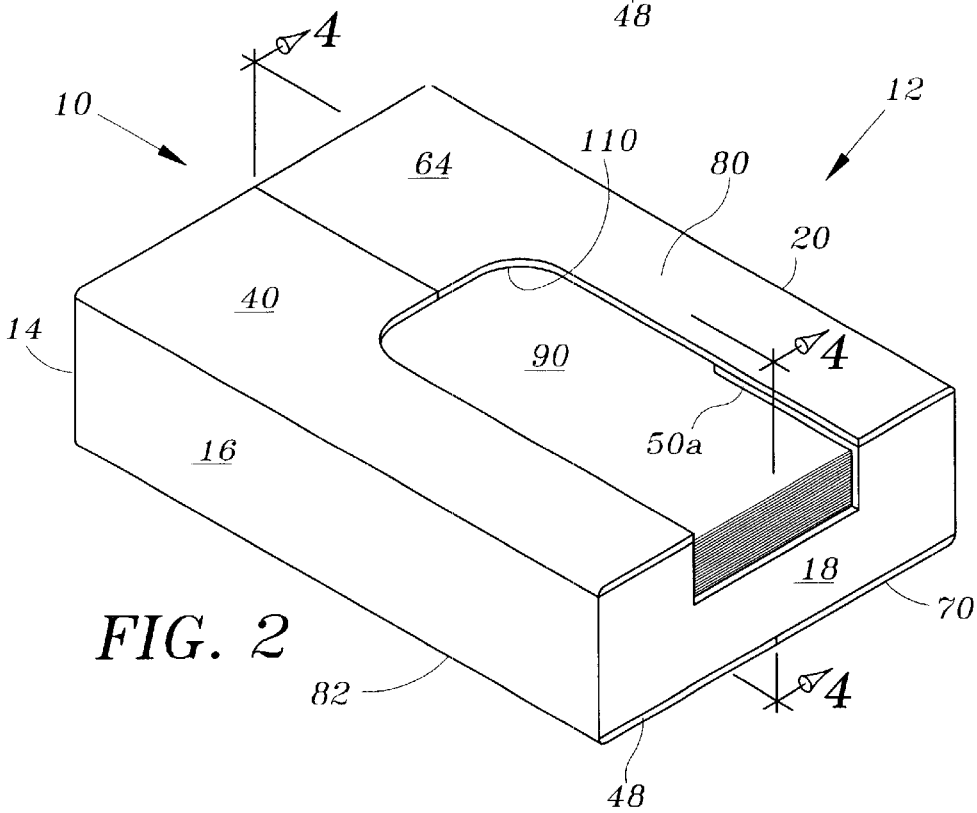
FIG. 2 is a perspective view of the present system showing the dispenser in the open position.
Figure 4:
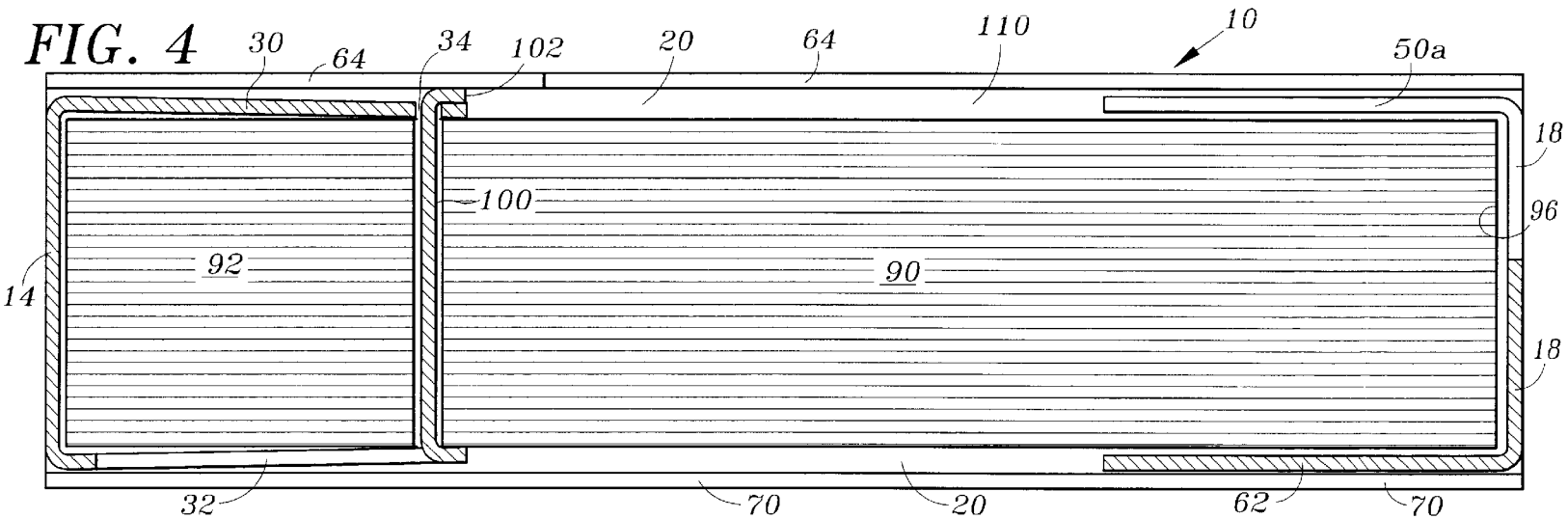
FIG. 4 is an enlarged sectional view of the present system taken generally along sectional lines 4—4 of FIG. 2.

FIG. 2 illustrates the present system in use for dispensing bags 90 wherein pullout portions 42, 66, 52, and 58 have been removed from top panel 80 and end panel 18 to provide access to the interior of container 12 for removal of bags 90. Bags 90 comprise individual bags which are stacked within container 12, as illustrated in FIG. 4, and are singularly removable from container 12 through the use of the present dispensing system. An illustrative embodiment of a bag 90 is illustrated in FIG. 7. Bag 90 is of the "T"-shirt type bag having handles 92, a top portion 94 and a bottom portion 96. Disposed adjacent to top portion 94 is an aperture 98, whose use will subsequently be described. Bag 90 is generally described in U.S. Pat. No. 5,074,674, entitled "Thermoplastic Bag", whose drawings and description are hereby incorporated by reference and may also include bags having a detachable tab, for example, the bag described in U.S. Pat. No. 4,676,378 entitled "Bag Pack", whose drawings and description are hereby incorporated by reference.

Referring now to FIG. 3, bags 90 are positioned within container 12 by folding open flaps 40 and 64, and then folding open the top flaps 30 and 50*a* and 50*b*.

Referring now to FIGS. 3–6, bags 90 are retained within container 12 utilizing a tongue 100 which is disposed within bottom flap 32. Tongue 100 is formed by perforations 100*a* within bottom flap 32. Tongue 100 is hingedly attached to bottom flap 32 along fold line 104, extending between apertures 36. Tongue 100 includes a tab 102 foldable along fold line 106. To install bags 90 within container 12, container 12 is positioned as illustrated in FIG. 3 with top panel 80 completely open. Tongue 100 is partially detached along perforations 100*a* from bottom flap 32 and is folded upwardly, substantially perpendicular to bottom flap 32 along fold line 104. Bags 90 are then loaded onto tongue 100 by aligning apertures 98 with tongue 100, and positioning bags 90, such that tongue 100 passes through bag apertures 98. Once bags 90 have been fully loaded on tongue 100, top flap 30 is folded parallel to bags 90 such that aperture 34 engages tab 102, and tab 102 is folded parallel to bags 90. Top flaps 50*a* and 50*b* are then folded parallel to bags 90. Finally, top flaps 40 and 64 are then folded parallel to bags 90 as illustrated in FIG. 2. Bags 90 can be singularly removed from container 12 by grasping bags 90 and pulling a bag 90 through aperture 110 formed by pullout portions 42, 66, 52, and 58. The pulling action severs the bag 90 between aperture 98 and bag top 94. Severance may be enhanced by having a portion of the bag perforated in the area of aperture 98. In the case of a bag having a detachable tab, tongue 100 is inserted in the tab aperture used to mount such bags to a dispensing rack hook.

It therefore can be seen that the present invention provides for a dispensing system that is quick and easy to use for the singular dispensing of plastic bags from a container wherein the container is utilized for storage of bags prior to dispensing.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A system for storing and dispensing bags, the bags each having a top and a bottom, and an aperture disposed adjacent the bag top, the system comprising:

a container having a top panel, a bottom panel, first and second side panels and first and second end panels;

a tongue formed in said bottom panel and adapted to pass through the bag apertures for retaining the bags within said container; and said container having an aperture to permit removal of bags from said container through said aperture.

2. The system of claim 1 wherein said tongue includes a tab for engaging an aperture formed in said top panel.

3. The system of claim 1 wherein said container aperture is disposed in said top panel.

4. The system of claim 1 wherein said container aperture is disposed in one of said end panels.

5. The system of claim 1 wherein said container aperture is disposed in said top panel and one of said end panels.

* * * * *